US006665913B2

(12) United States Patent
Kosh et al.

(10) Patent No.: US 6,665,913 B2
(45) Date of Patent: Dec. 23, 2003

(54) END-FITTING WEBBING BUCKLE

(75) Inventors: Matthew Kosh, Seattle, WA (US); John N. Tilden, Bellevue, WA (US)

(73) Assignee: Bodypoint Designs, Inc., Seattle, WA (US)

( * ) Notice: Subject to any disclaimer, the term of this patent is extended or adjusted under 35 U.S.C. 154(b) by 0 days.

(21) Appl. No.: 10/194,861

(22) Filed: Jul. 12, 2002

(65) Prior Publication Data

US 2003/0041420 A1 Mar. 6, 2003

Related U.S. Application Data

(60) Provisional application No. 60/317,370, filed on Sep. 4, 2001.

(51) Int. Cl.[7] ..... A44B 11/25

(52) U.S. Cl. ..... 24/193; 24/191; 24/196; 24/197; 24/170

(58) Field of Search ..... 24/193, 191, 196, 24/194, 197, 184, 170, 68 CD; 280/808; 297/483

(56) References Cited

U.S. PATENT DOCUMENTS

| | | | | | |
|---|---|---|---|---|---|
| 2,919,481 | A | * | 1/1960 | Finken et al. | 24/196 |
| 3,253,309 | A | * | 5/1966 | Baresch | 24/170 |
| 3,390,436 | A | * | 7/1968 | Prete, Jr. | 24/196 |
| 3,413,691 | A | * | 12/1968 | Elsner | 24/170 |
| 4,843,688 | A | * | 7/1989 | Ikeda | 24/170 |
| 5,311,653 | A | * | 5/1994 | Merrick | 24/196 |
| 5,661,877 | A | * | 9/1997 | Bloomer | 24/170 |
| 5,920,963 | A | * | 7/1999 | Chou | 24/170 |
| 6,381,810 | B2 | * | 5/2002 | Hsieh | 24/170 |

* cited by examiner

*Primary Examiner*—Victor Sakran
(74) *Attorney, Agent, or Firm*—Leydig, Voit & Mayer, Ltd.

(57) ABSTRACT

An end-fitting buckle having a cam cover that allows webbing to be inserted when the cam cover is in an up position. After inserted, a free end of the webbing is pulled to tighten the webbing while the cover is in an intermediate position. The cover may then be closed to lock both the free end and load end. When the cover is locked, movement of the load end is prevented by teeth in the cam cover. The teeth lock the free end into place, holding the set position of the webbing. The cover design also promotes use of varied thicknesses of webbing, because the cam action of the cover utilizes friction between the two ends of the webbing instead of a pinching action.

21 Claims, 9 Drawing Sheets

END-FITTING WEBBING BUCKLE

REFERENCE TO RELATED APPLICATION

This application claims the benefit of U.S. Provisional Application No. 60/317,370, filed Sep. 4, 2001, incorporated herein by reference.

FIELD OF THE INVENTION

The present invention relates generally to buckles, and more particularly to end-fitting buckles that may be used to secure webbing.

BACKGROUND OF THE INVENTION

End-fitting buckles are used to secure one end of webbing to an object. For example, webbing may be attached to some wheelchairs to strap a patient into a seated position in the wheelchair. If used in this manner, the webbing typically requires a length adjustment by a professional in order to properly fit the patient. In many applications, it is desirable that the webbing setting not be carelessly changed after set by the professional.

Although some prior art end-fitting buckles work well for their intended purpose, there are a few problems inherent in their use, especially when precise webbing length adjustments must be established and maintained. For most end-fitting buckles, after the webbing has been threaded through the end-fitting buckle, pulling on the load end of the webbing usually does not affect the professionally-set setting. However, the webbing length may be accidentally changed from the setting by simply pulling the loose, or free, end of the webbing. If a user accidentally or carelessly pulls on the free end and changes the setting, a professional is once again needed to properly reset the webbing length.

For many prior art end-fitting buckles, constant tension on the load end is required to maintain the webbing setting. However, for many applications, tension in the webbing may be intermittently released during use, causing the webbing setting to be lost, and requiring resetting of the webbing length.

In addition to the above problems, most prior art end-fitting buckles are designed to function properly only when used with webbing of a specific thickness. For these buckles, webbing which is too thin or thick tends to slip under tension or cannot be threaded through the buckle at all. Moreover, even if a proper thickness is used, many prior art end-fitting buckles are designed so that threading webbing through the end-fitting buckle is awkward and confusing.

SUMMARY OF THE INVENTION

The present invention provides an end-fitting buckle that permits versatile and secure connection to an end of a webbing. The end-fitting buckle includes a cam cover that rotates to allow webbing to be inserted when the cam cover is in a fully opened position. Once inserted, the free end of the webbing is pulled to tighten the webbing on the load end while the cover is in an intermediate position. The cover may then be closed to lock both the free end and the load end.

The end-fitting buckle includes a sliding, knurled bar, around which the webbing is threaded. The free end of the webbing extends over the sliding, knurled bar, then down and under a cam surface on the cam cover. In both the intermediate and locked positions, the cam surface forces the free end of the webbing into contact with the load end of the webbing. In the intermediate position, only a partial, flat edge of the cam cover is in contact with the free end (i.e., top layer) of the webbing. Pulling on the load end causes the sliding, knurled bar to slide toward the cam surface of the cam cover, pinching the free end between the cam surface and the sliding, knurled bar. Further pulling force on the load end tightens the clamping of the free end between the sliding, knurled bar and the cam surface, preventing retraction of the webbing in the load end direction.

While the buckle is in the intermediate position, the webbing may be pulled at the free end to cinch the webbing in place. Pulling the webbing in this direction releases the pinching effect of the sliding, knurled bar and the cam surface on the free end, because the cam surface extends below the sliding, knurled bar, and pulling out on the free end puts a downward, rearward force on the sliding, knurled bar, moving it slightly away from the cam surface and releasing the free end.

When the cover is closed, movement of the free end of the webbing is prevented by teeth in the cam cover. The teeth lock the free end into place, holding the set position of the webbing.

The sliding, knurled bar allows easy feeding of the webbing, and permits different thicknesses of webbing to be used with the buckle. The cover design also provides use of varied thicknesses of webbing, because the cam action of the cover utilizes friction between the sliding, knurled bar and the cam surface, instead of a pinching action of the two webbing ends together.

The teeth press the webbing and sliding, knurled bar forward to tightly engage with the cam section of the cover, thus preventing loosening when tension is released from the load end of the webbing. This positive engagement is ensured by a snap-locking feature at the rear of the cover, which may close with an audible click to indicate proper locking. Unlocking the cover may require the use of a flat tool such as a screwdriver or a coin, thereby preventing accidental release of the webbing.

Other features are provided in the buckle of the present invention. A hump in the base plate for the end-fitting buckle may be provided for forcing the webbing upward and thereby promotes easier feeding. The cover acts as a spring to ensure proper engagement of the teeth with the webbing across a wide range of thicknesses, and slightly deforms against the spring action to close and snap the cover into place. The cover is configured such that force applied to the webbing causes the cover to tighten on the frame of the end-fitting buckle.

Other advantages will become apparent from the following detailed description when taken in conjunction with the drawings, in which:

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well-known features may be omitted or simplified in order not to obscure the present invention. In addition, to the extent that orientations of the invention are described, such as "top," "bottom," "front," "rear," and the like, the orientations are to aid the reader in understanding the invention, and are not meant to be limiting.

Figure 1:
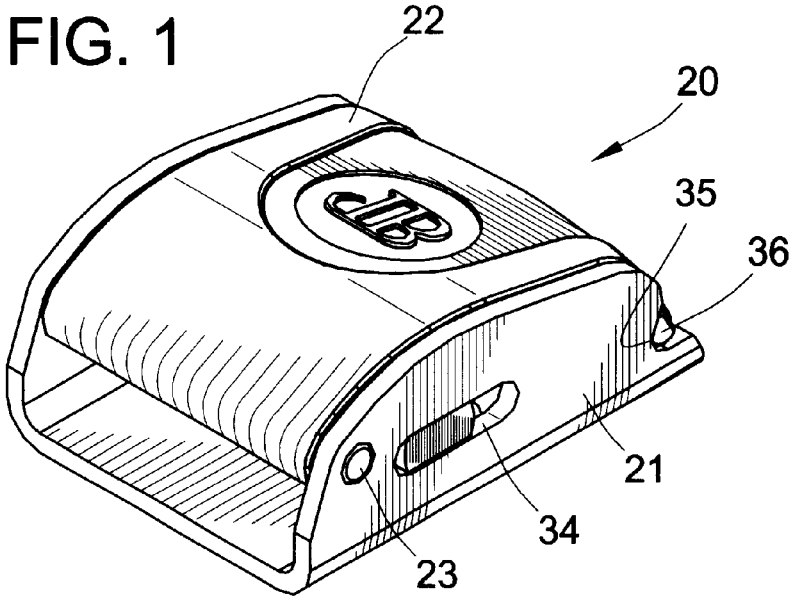
FIG. 1 is a perspective view of an end-fitting buckle incorporating the present invention.
Figure 16:
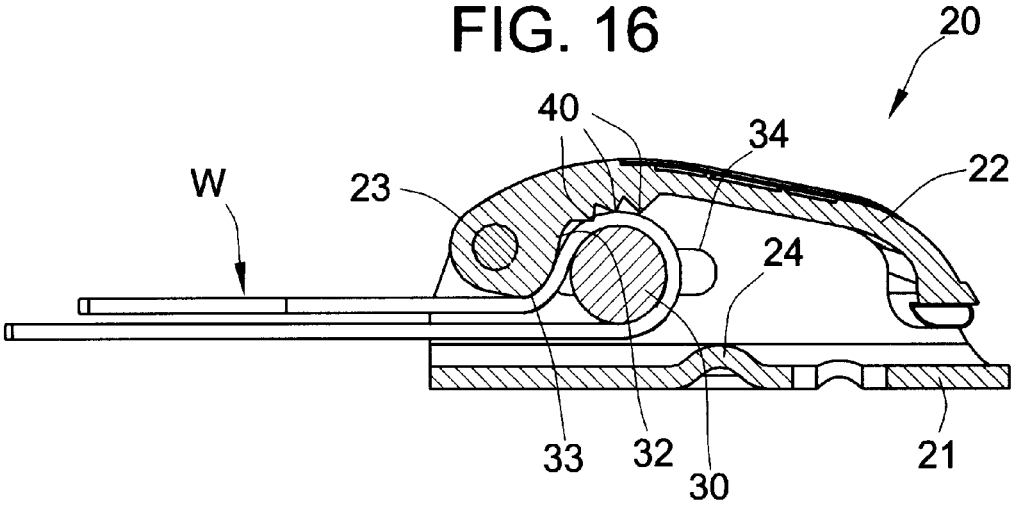
FIG. 16 is a side cross-sectional view of the end-fitting buckle of FIG. 11.
Figure 17:
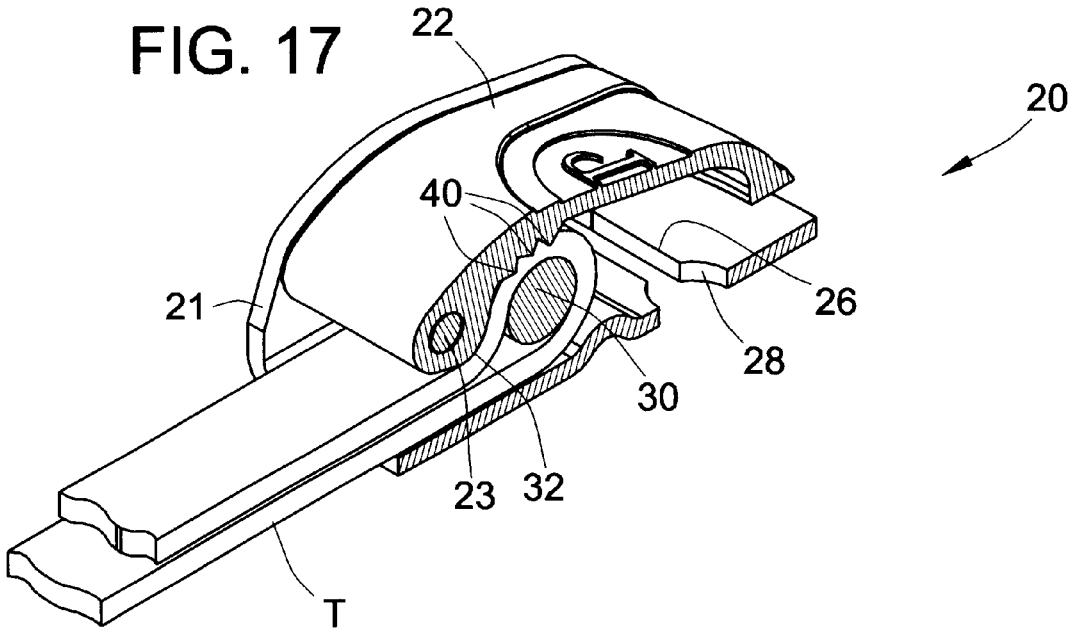
FIG. 17 is a perspective, cross-sectional view of the end-fitting buckle of FIG. 1, similar to FIG. 15, showing the cam cover of the end-fitting buckle completely closed with a thicker webbing threaded through the end-fitting buckle.
Figure 18:
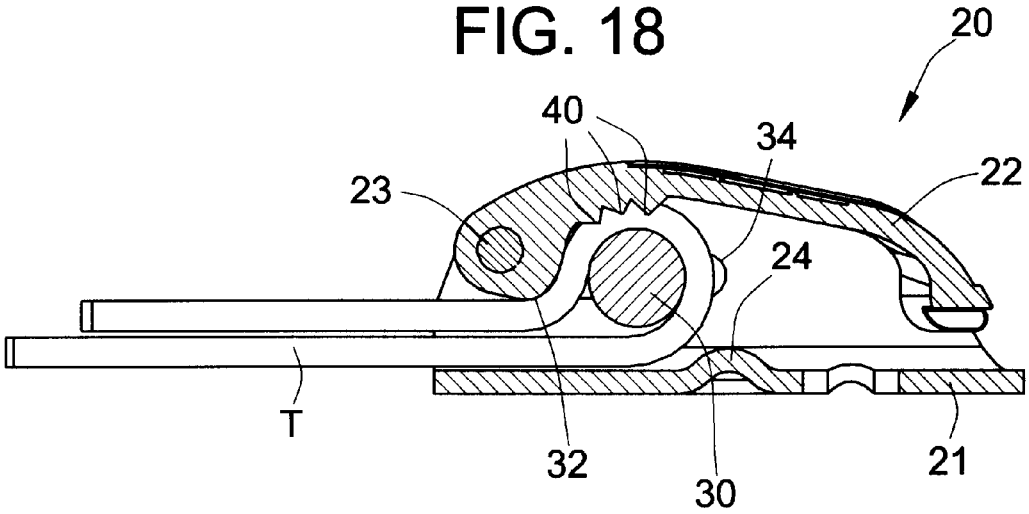
FIG. 18 is a side cross-sectional view of the end-fitting buckle of FIG. 17.

Turning now to the drawings, in which like reference numerals represent like parts throughout the several views, FIG. 1 shows an end-fitting buckle 20 having a cam cover 22 in accordance with the present invention. Briefly described, the cam cover 22 may be raised to an opened position to allow webbing W to be inserted (FIG. 5), and may be lowered to a closed position to lock the webbing in place (FIG. 16).

In general, as used herein, webbing is any strap, harness, or elongate piece of material made of a variety of flexible materials. However, the end-fitting buckle of the present invention has particular application for use in securing webbing formed from strong, narrow, closely woven straps designed for bearing weight.

A frame 21 for the end-fitting buckle 20 is preferably formed of steel or another strong metal, but may be formed of other suitable materials. The cam cover 22 may be plastic or metal, but preferably is a material that allows it to have spring-like qualities, the functions of which are described further below. A person of ordinary skill in the art may select suitable materials for the frame 21 and the other components of the end-fitting buckle described herein.

The cam cover 22 is mounted for rotation about a pin 23, and includes a cam surface 32 (FIG. 6) on its lower side. The end-fitting buckle 20 includes a sliding, knurled bar 30 around which the webbing is threaded. The sliding, knurled bar 30 may be formed of steel or another suitable material. The cam surface 32 is arranged to extend lower than the top surface of the sliding, knurled bar 30 when the cam cover 22 is closed, the function of which is described below.

The knurled bar 30 is held captive in slots 34 in the sides of the frame 21 of the end-fitting buckle 20, but is free to slide rearward to create a large gap for feeding the webbing W back out of the mouth (i.e., the gap between the cam cover 22 and the bottom of the frame 21) of the end-fitting buckle. Movement in the slot is also a feature that accommodates webbing W of different thicknesses, as described further below.

Figure 2:
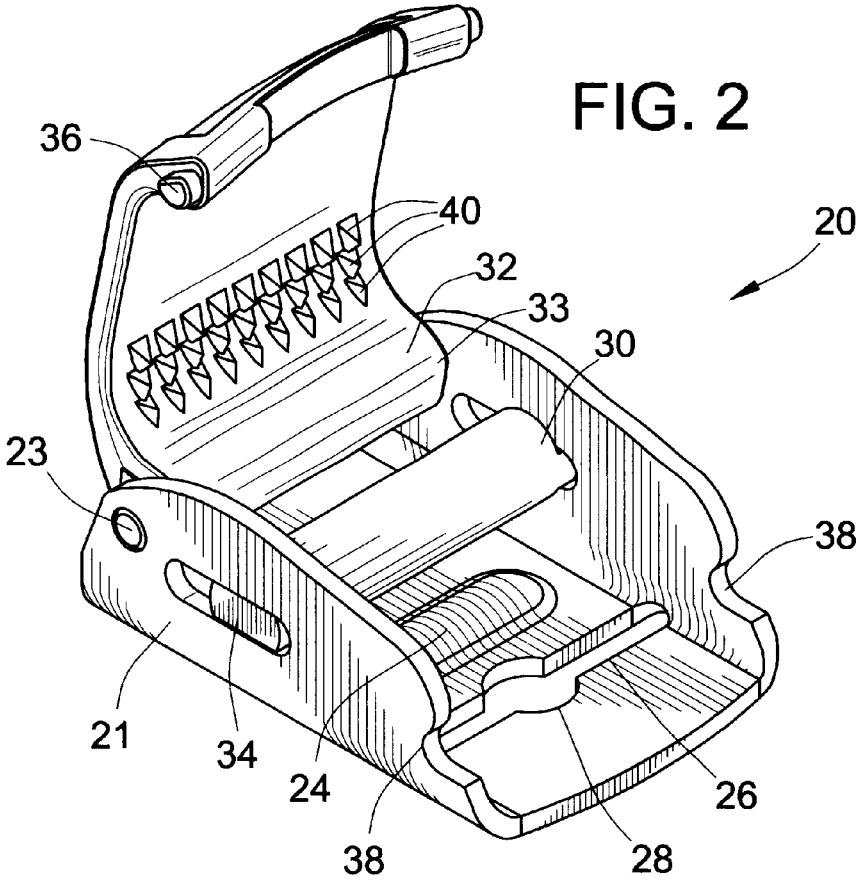
FIG. 2 is a rear perspective view of the end-fitting buckle of FIG. 1, with a cam cover of the end-fitting buckle shown in an opened position.
Figure 3:
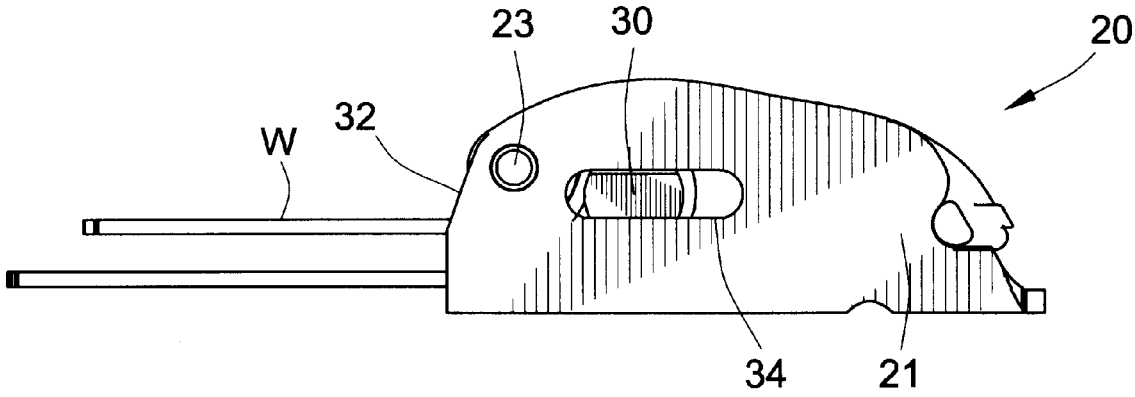
FIG. 3 is a side view of the end-fitting buckle of FIG. 1, showing the cam cover closed and webbing threaded through the end-fitting buckle.
Figure 4:
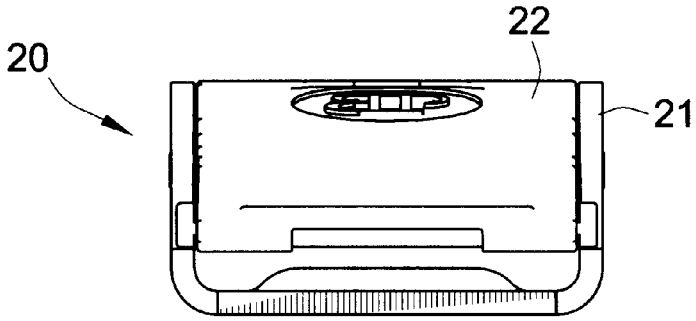
FIG. 4 is an end view of the end-fitting buckle of FIG. 1.

A hump 24 (FIG. 2) in the metal on the bottom of the end-fitting buckle 20 is positioned just rearward of the knurled bar 30. The bottom also includes a slot 26 having a fastener hole 28 (FIG. 2) therein. The slot 26 and the fastener hole 28 allow the end-fitting buckle to be attached to a hook or a fastener 29 (FIG. 6 only), respectively. The slot 26 may also receive a webbing strap so as to form a belt. The fastener 29 may be attached to a variety of different structures, including, but not limited to, clamps, frames, panels, or any other structure to which a webbing end needs to be attached.

Figure 5:
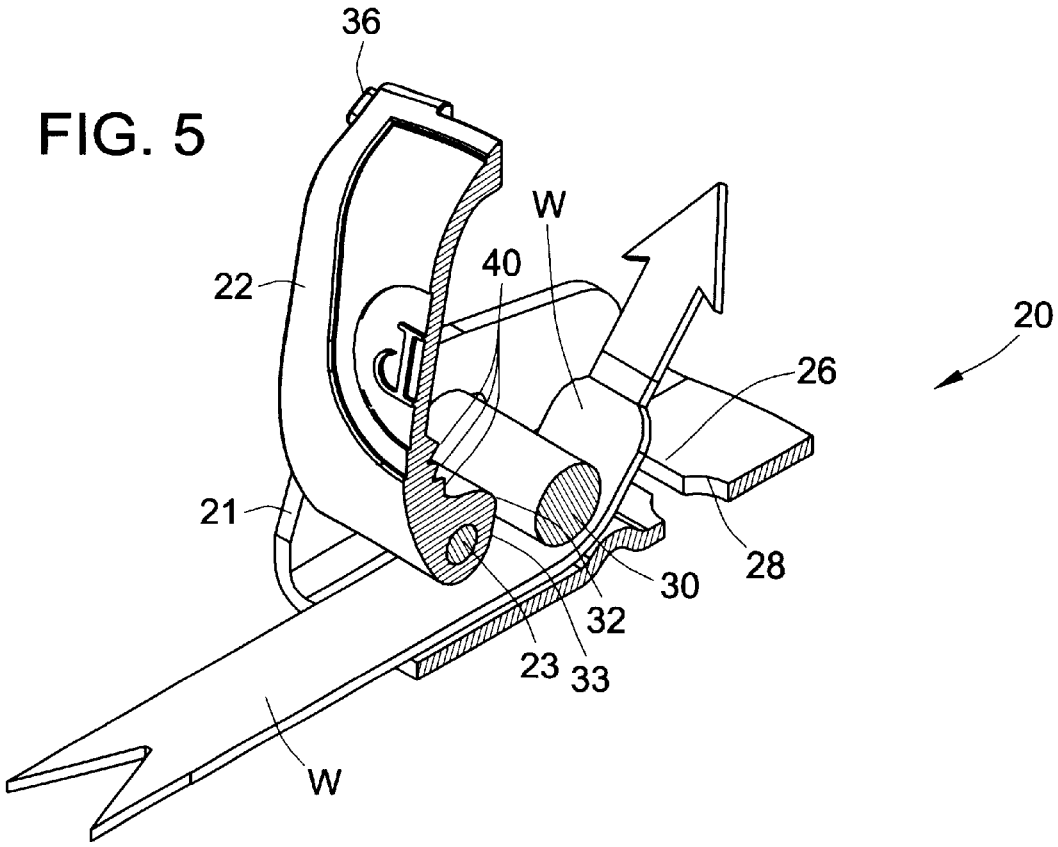
FIG. 5 is a perspective, cross-sectional view of the end-fitting buckle of FIG. 1, with the cam cover opened similar to FIG. 2, and webbing partially advanced into the end-fitting buckle.
Figure 6:
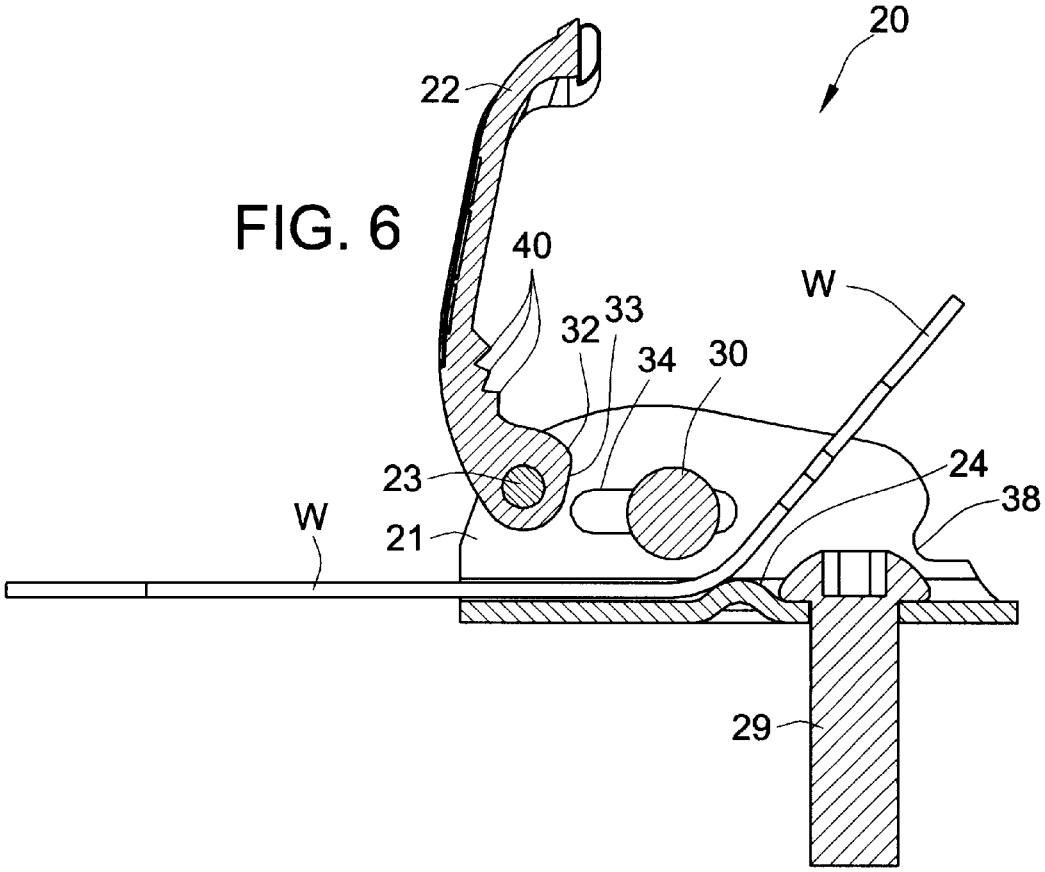
FIG. 6 is a side cross-sectional view of the end-fitting buckle of FIG. 5.

The hump 24 is positioned so that when webbing is inserted in a gap formed between the cam cover 22 and the bottom of the frame 21 for the end-fitting buckle, the hump 24 forces the webbing W upward to promote easier feeding (FIGS. 5 and 6). The hump 24 deflects the end of the webbing W upward to prevent jamming against the head of a bolt or other fastener (where used) in the fastener hole 28, and presents the webbing W above the frame 21 to permit easy grasping with the fingers for feeding around the knurled bar 30.

Figure 7:
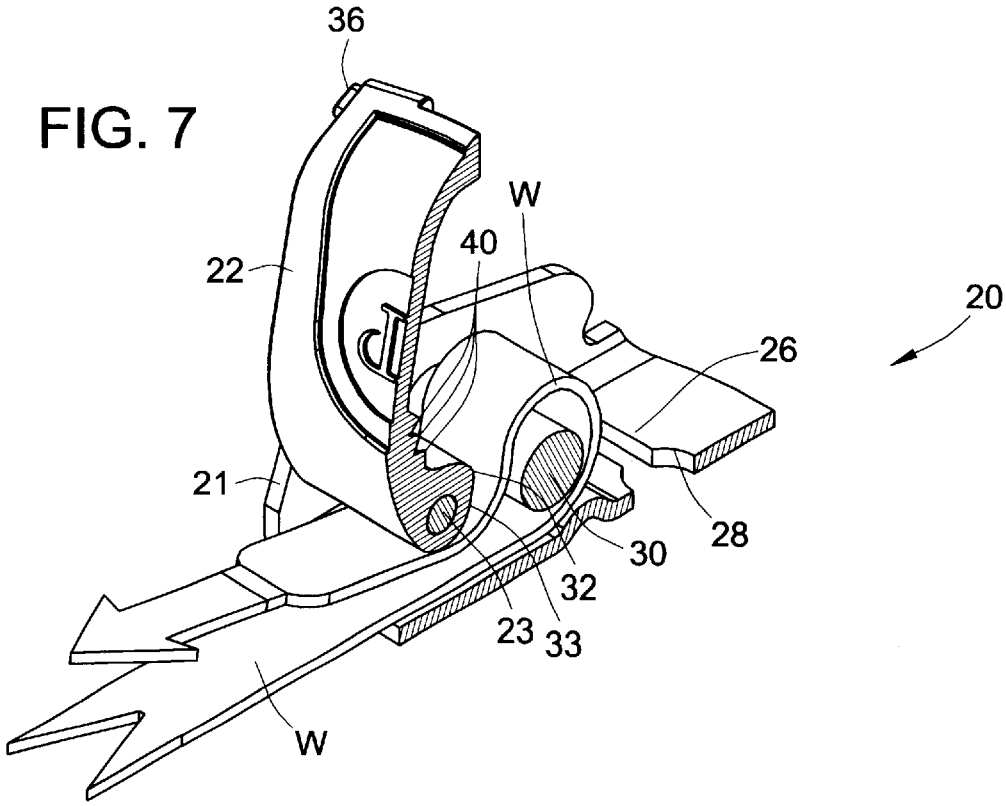
FIG. 7 is a perspective, cross-sectional view of the end-fitting buckle of FIG. 1, similar to FIG. 5, showing webbing further advanced into the end-fitting buckle.
Figure 8:
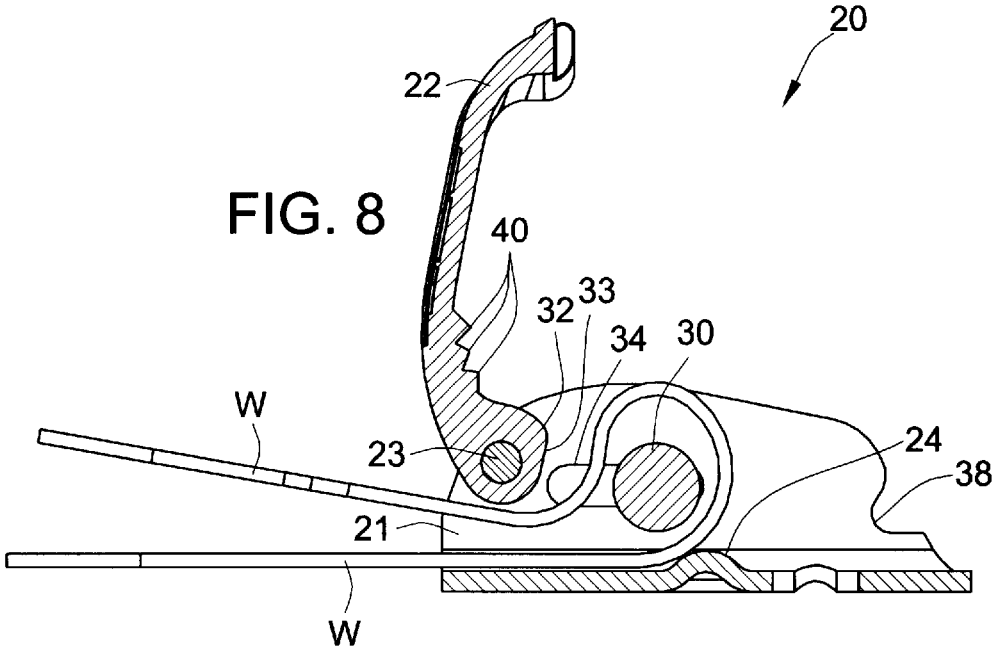
FIG. 8 is a side cross-sectional view of the end-fitting buckle of FIG. 7.
Figure 9:
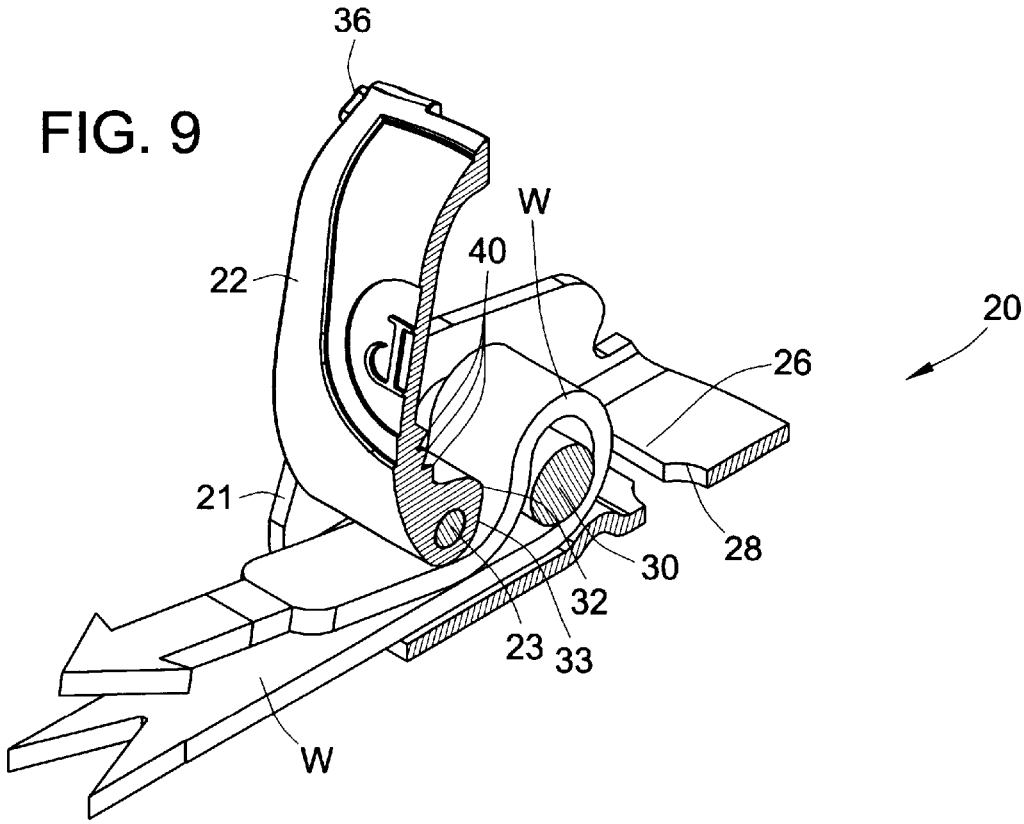
FIG. 9 is a perspective, cross-sectional view of the end-fitting buckle of FIG. 1, similar to FIG. 7, showing a thicker webbing advanced into the end-fitting buckle.
Figure 10:
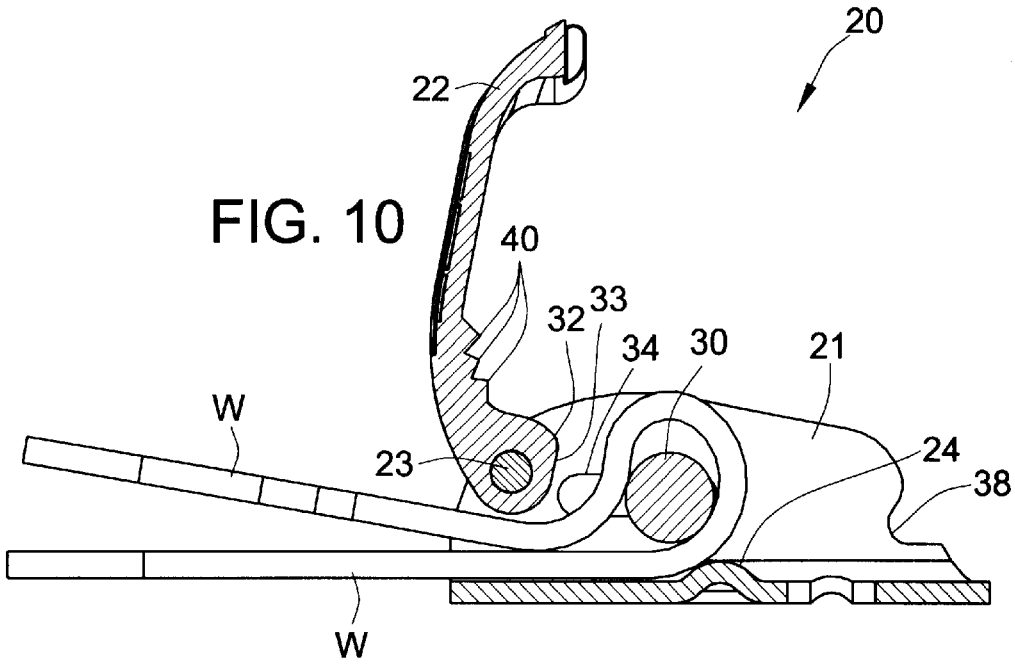
FIG. 10 is a side cross-sectional view of the end-fitting buckle of FIG. 9.
Figure 11:
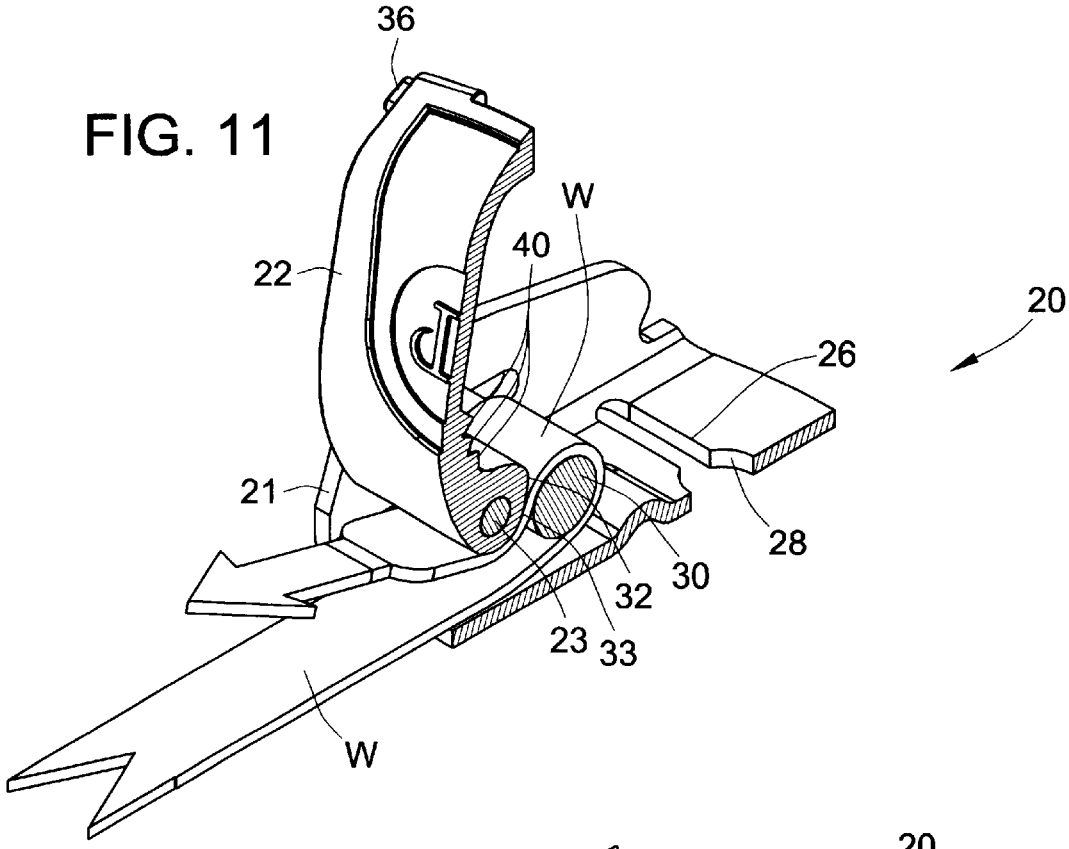
FIG. 11 is a perspective, cross-sectional view of the end-fitting buckle of FIG. 1, similar to FIG. 7, showing the webbing cinched and even further advanced into the end-fitting buckle.
Figure 12:
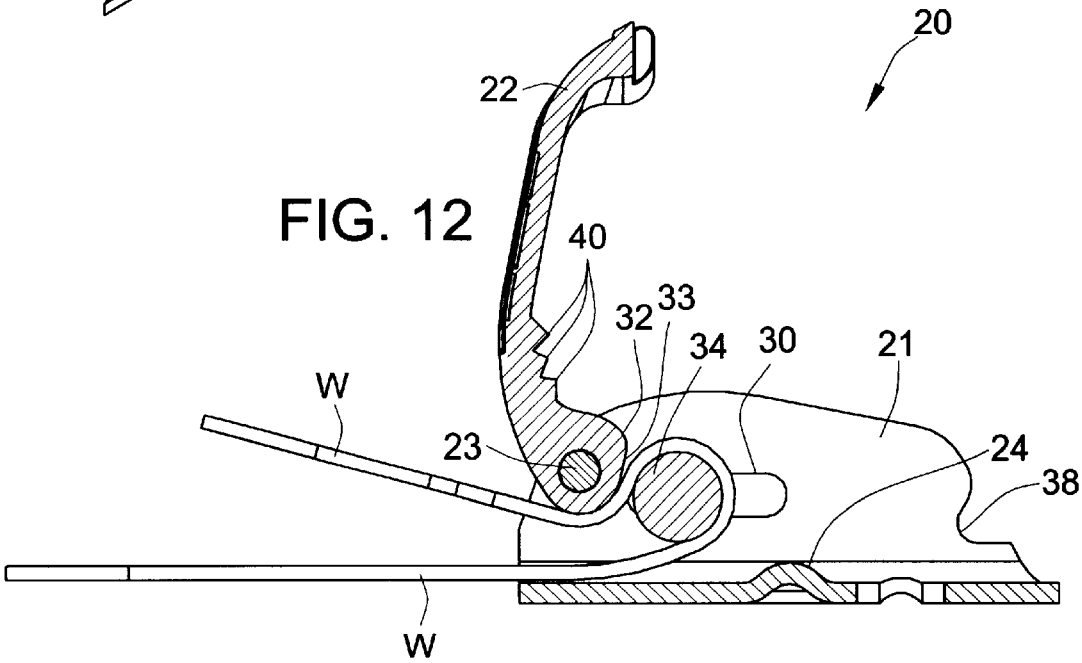
FIG. 12 is a side cross-sectional view of the end-fitting buckle of FIG. 11.

With the cam cover 22 in a wide open position (FIGS. 5–8), the cam surface 32 is raised away from the mouth of the end-fitting buckle 20, creating a large opening to facilitate insertion and pulling through of webbing within a wide range of thicknesses (e.g., 0.040 to 0.070 inches thick). After the webbing W is inserted (FIGS. 5 and 6) and wrapped around the knurled bar 30, the free end of the webbing W is inserted between the knurled bar 30 and the cam surface 32 on the bottom of the cam cover 22 (FIGS. 7 and 8). At this point, it is possible to adjust the webbing W by pulling on either the load end or the free end for thinner webbing, or by rolling backward with the thumb against the knurled bar 30 to assist the adjustment of thicker webbing W. Generally, to remove slack from the webbing W, the free end of the webbing W is pulled to move the knurled bar 30 toward the cam surface 32 (FIGS. 11 and 12).

Figure 13:
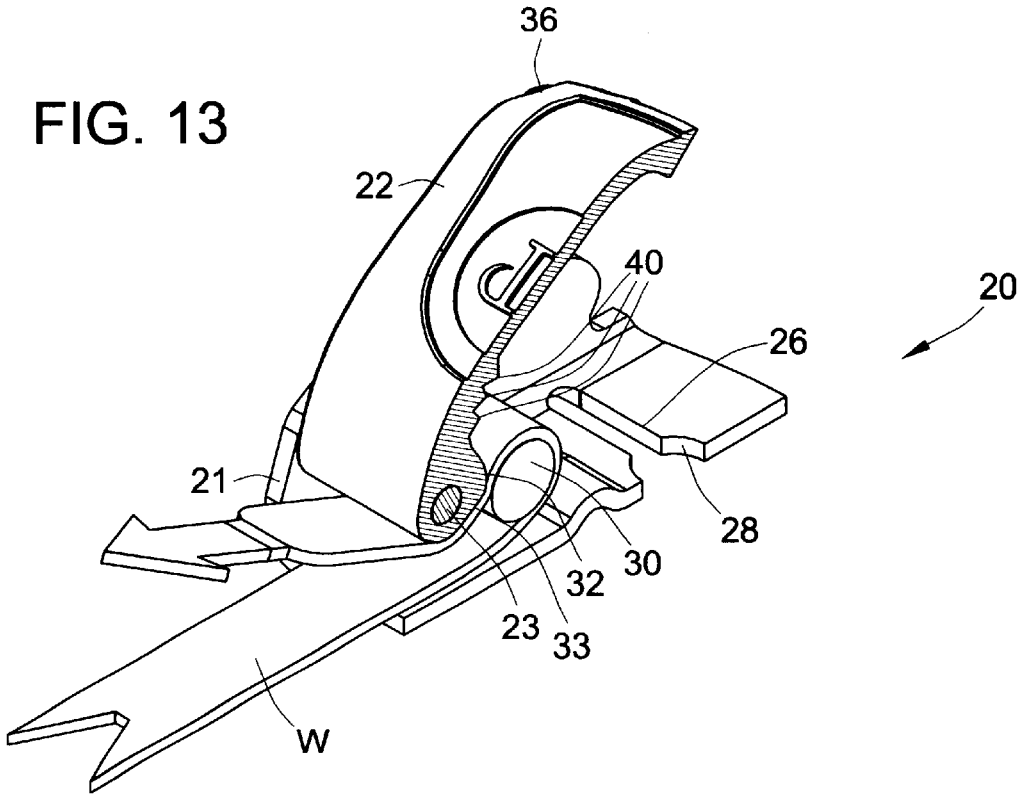
FIG. 13 is a perspective, cross-sectional view of the end-fitting buckle of FIG. 1, similar to FIG. 11, showing the cam cover of the end-fitting buckle at an intermediate stage of closing.
Figure 14:
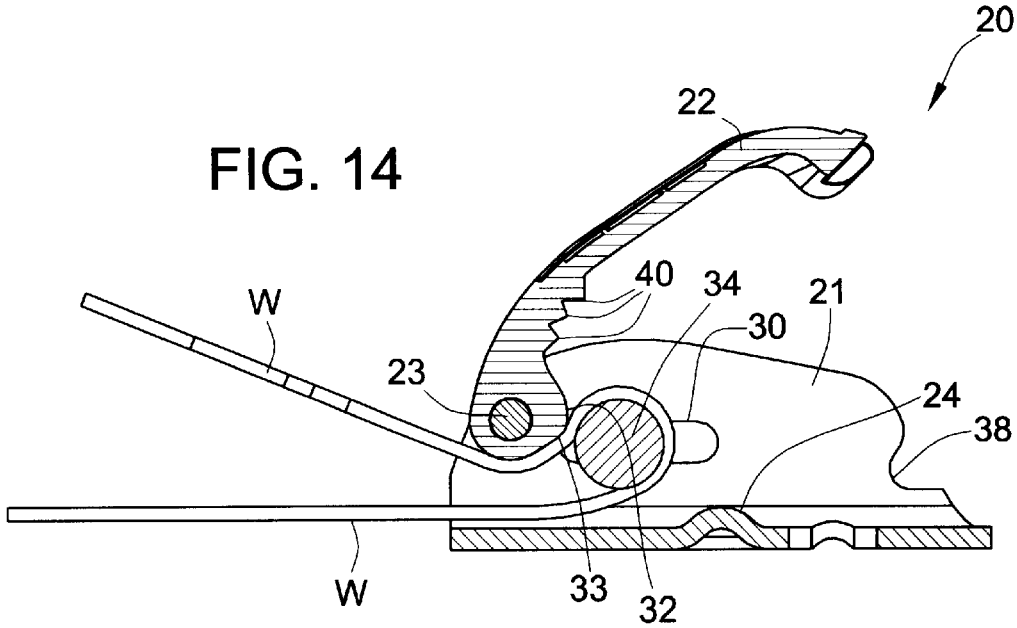
FIG. 14 is a side cross-sectional view of the end-fitting buckle of FIG. 13.
Figure 15:
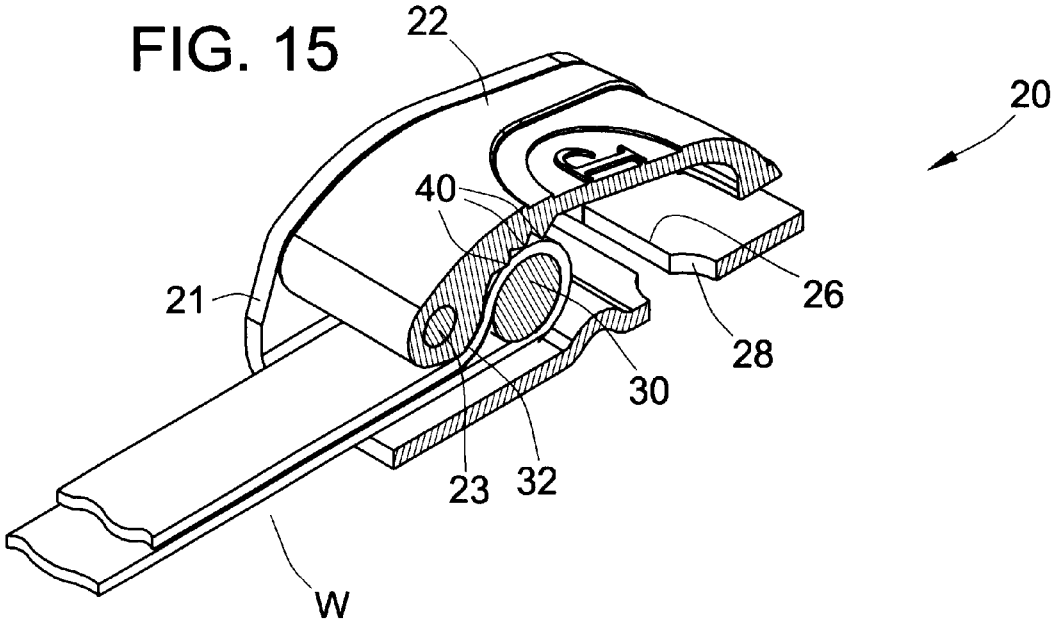
FIG. 15 is a perspective, cross-sectional view of the end-fitting buckle of FIG. 1, similar to FIG. 13, showing the cam cover of the end-fitting buckle completely closed.

The webbing W may be tightened while the cover 22 is in an intermediate position (FIGS. 13 and 14). With the cam cover 22 partially closed and the slack removed from the webbing W, the free end of the webbing W is trapped between the cam surface 32 and the sliding, knurled bar 30. Because the cam surface 32 extends below the sliding, knurled bar 30, the webbing W wraps around and extends downward from the sliding, knurled bar 30. This wrap-around effect causes a self-locking effect against any increasing pull on the load end. Pulling on the load end of the webbing W drives the sliding, knurled bar 30 toward the cam surface 32, further tightening the grip on the free end of the webbing W. Moreover, pulling out on the load end captures the free end of the webbing W between the cam surface 32 and the load end, and increases the pressure and friction between the two ends. In this manner, the end-fitting buckle 20 utilizes (1) the pinching of the free end between the sliding, knurled bar 30 and the cam surface 32, and (2) the friction between the free end and the load end of the webbing W to prevent retraction of the webbing W in the load end direction. These two components are both still present when the cam cover 22 is closed, but the effect is magnified because the cam surface 22 moves downward to enhance the wrap-around effect. Any force applied to the load end serves to draw the knurled bar 30 forward, creating a sharper bend in the webbing W and increasing the friction.

When the cover 22 of the end-fitting buckle 20 is in the intermediate position (FIGS. 13 and 14), the webbing W may be pulled by its free end to tighten or cinch the webbing W in place. When the free end is pulled, the load end is free to settle toward the bottom of the end-fitting buckle 20, releasing the friction between the free end and the load end of the webbing W. If thicker webbing W is used, there may be little space available for the load end to move downward, but in any event significant pressure is not applied upward by the load end. Moreover, the wrap-around effect does not occur on this side of the webbing W, because the free end extends down below the cam surface 32 and then up to and over the sliding, knurled bar 30. Thus, pulling on the free end does not pull the sliding, knurled bar 30 forward, but instead puts a downward rearward force on the sliding, knurled bar 30, which permits the webbing W to be released, and the free end to be cinched.

The cover 22 includes a straight section 33 (best shown in FIGS. 13 and 14) adjacent to the cam surface 32 that permits the free end to slide outward during cinching. This cinching action is aided by mechanical advantage owing to the pulley-like action of drawing the webbing W around the knurled bar 30 (the force is cut in half).

After cinching of the webbing W, the cover 22 may be closed to lock both the free end and the load end (FIGS. 15–18). Thus, the distal end of the cover 22 includes detents 36 that fit into notches 38 on the frame 21 of the end-fitting buckle 20. The engagement of the detents 36 into the notches 38 provides a snap-locking feature at the rear of the cam cover 22, which may close with an audible click to indicate proper locking. The audible click may be less noticeable or even absent for thicker webbing.

The detents 36 may be one of many structures (e.g., a protrusion, a catch, a dog, or a spring-operated ball) for positioning and holding the cover 22 in relation to the frame 21 of the end-fitting buckle 20 so that the cam cover 22 may be released by force applied to the frame 21 or the cover. The detents 36 may firmly fit into the notches 38 so that unlocking the cam cover 22 (i.e., removing the detents 36 from the notches 38) requires the use of a flat tool such as a screwdriver or a coin, thereby preventing accidental release of the webbing W. With the cam cover 22 fully closed, as indicated by an audible "click," the cam surface 32 closes the gap for the webbing W, creating a sharp bend in the webbing W, which provides a secure grip against forces applied to the load end. In both the intermediate and locked positions, the cam surface 32 forces the free end of the webbing W into contact with the load end of the webbing W.

When the cam cover 22 is locked (FIGS. 15 and 16), movement of the free end is prevented by teeth 40 (best shown in FIG. 2) in the cam cover. The teeth 40 penetrate the webbing W and secure the knurled bar 30 in its forward position (one tooth always falls behind the center of the knurled bar 30) to prevent any slipping induced by repeated tightening and slackening of the load end, and simultaneously grips the free end of the webbing W to discourage readjustment of the belt length by untrained users. The flexible design of the cam cover 22 acts as a spring to ensure proper engagement of the teeth 40 with the range of webbing W thicknesses specified, and provides a preload to the snap feature found at the rear of the cam cover.

The cam cover 22 is also designed to be self-locking, in that increasing force from the webbing W against the teeth 40 serves to bend the cover and draw the detents 36 more tightly into the notches 38 in the frame 21. Moreover, pulling on the load end of the webbing W causes the sliding, knurled bar 30 to press against a rear side of the cam surface 32, which is sloped inward and thus further biases the cam cover 22 into the closed position.

There is no practical limit to the ability of the design to resist force on the load end, and no slipping occurs until there is a break or deformation in one of the metal components (performance tests have found no failure below 900 lbs). If desired, to increase the strength of the metal components, the slot 26 may not be included or may be reinforced.

The sliding, knurled bar 30 allows easy feeding of the webbing W, and permits different thicknesses of webbing to be used with the end-fitting buckle. For example, FIGS. 9, 10, 17 and 18 show webbing T that is thicker than the webbing W, but still may be used with the end-fitting buckle 20. The cover design also promotes use of varied thicknesses of webbing, because the cam action of the cam cover 22 utilizes friction between the two ends of the webbing instead of a pinching action.

Variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention.

What is claimed is:

1. An end-fitting buckle, comprising:

a frame having a bottom;

a cover pivotally attached to the frame at a location on the frame spaced from the bottom so as to form a gap therebetween, the cover having a tail spaced from the pivotal attachment to the frame, the cover being rotatable between an opened position and a closed position, the tail being spaced from the bottom more in the opened position than the closed position;

teeth mounted on a side of the cover, the teeth mounted so that they face the bottom when the cover is in the closed position; and a sliding bar connected for sliding movement relative to the frame, the sliding bar being mounted between the bottom and the cover when the cover is in the closed position;

wherein the teeth and the sliding bar are arranged so that a webbing is capable of being routed into the gap, around the sliding bar, and back through the gap, with the teeth engaging a portion of the webbing when the cover is in the closed position.

2. The end-fitting buckle of claim 1, further comprising a lock for holding the cover in the closed position.

3. The end-fitting buckle of claim 2, wherein the lock comprises a detent.

4. The end-fitting buckle of claim 1, further comprising a cam surface on a side of the cover that faces the bottom when the cover is in the closed position, the cam surface being positioned so that it extends downward from the cover between the pivotal connection of the cover and the sliding bar when the cover is in the closed position.

5. The end-fitting buckle of claim 4, further comprising a flat surface mounted on the cover forward of the cam surface and sloping upward from the cam surface.

6. The end-fitting buckle of claim 5, wherein the cam surface is configured so that, when a webbing is threaded through to end-fitting buckle and a outward force is applied on a lower end of the webbing, to cover is biased downward by action of the force on the cam surface.

7. The end-fitting buckle of claim 4, wherein the cam surface is configured so that, when a webbing is threaded through the end-fitting buckle and a outward force is applied on a lower end of the webbing, the cover is biased downward by action of the force on the cam surface.

8. The end-fitting buckle of claim 1, wherein the teeth are configured and situated so that, when a webbing is threaded through the end-fitting buckle and a outward force is applied on a lower end of the webbing, the cover is biased downward by action of the force on the teeth.

9. The end-fitting buckle of claim 1, further comprising a hump on the bottom positioned rearward of the sliding bar and for directing webbing inserted through the gap upward from the bottom.

10. The end-fitting buckle of claim 1, wherein the cover is spring loaded so that it may stretch outward from the closed position.

11. The end-fitting buckle of claim 1, wherein the frame, the sliding bar, and the cover are positioned and configured so that a webbing may be routed therebetween, the webbing having a thickness that is less than half a height of the gap.

12. An end-fitting buckle, comprising:

a frame having a bottom;

a cover pivotally attached to the frame at a location on the frame spaced from the bottom so as to form a gap therebetween, the cover having a tail spaced from the pivotal attachment to the frame, the cover being rotatable between an opened position and a closed position, the tail being spaced from the bottom more in the opened position than the closed position;

a sliding bar connected for sliding movement relative to the frame, the sliding bar being mounted between the bottom and the cover when the cover is in the closed position; and a cam surface on a side of the cover that faces the bottom when the cover is in the closed position, the cam surface being positioned so that it extends downward from the cover between the pivotal connection of the cover and the sliding bar when the cover is in the closed position, and at least a portion of the cam surface extends closer to the bottom than a top surface of the sliding bar when the cover is in the closed position.

13. The end-fitting buckle of claim 12, wherein the cam surface is configured so that, when a webbing is threaded through the end-fitting buckle and a outward force is applied on a lower end of the webbing, the cover is biased downward by action of the force on the cam surface.

14. The end-fitting buckle of claim 12, further comprising a lock for holding the cover in the closed position.

15. The end-fitting buckle of claim 14, wherein the lock comprises a detent.

16. The end-fitting buckle of claim 12, wherein the cover is spring loaded so that it may stretch outward from the closed position.

17. The end-fitting buckle of claim 12, wherein the frame, the sliding bar, and the cover are positioned and configured so that webbing is capable of being trapped therebetween, the webbing having a thickness that is less than half a height of the gap.

18. An end-fitting buckle, comprising:

a frame having a bottom;

a cover pivotally attached to the frame at a location on the frame spaced from the bottom so as to form a gap therebetween, the cover having a tail spaced from the pivotal attachment to the frame, the cover being rotatable between an opened position and a closed position, the tail being spaced from the bottom more in the opened position than the closed position;

a sliding bar connected for sliding movement relative to the frame, the sliding bar being mounted between the bottom and the cover when the cover is in the closed position;

a cam surface on a side of the cover that faces the bottom when the cover is in the closed position, the cam surface being positioned so that it extends downward from the cover between the pivotal connection of the cover and the sliding bar when the cover is in the closed position; and a flat surface mounted on the cover forward of the cam surface and sloping upward from the cam surface.

19. The end-fitting buckle of claim 18, wherein the cam surface is configured so that, when a webbing is threaded through the end-fitting buckle and a outward force is applied on a lower end of the webbing, the cover is biased downward by action of the force on the cam surface.

20. An end-fitting buckle, comprising:

a frame having a bottom;

a cover pivotally attached to the frame at a location on the frame spaced from the bottom so as to form a gap therebetween, the cover having a tail spaced from the pivotal attachment to the frame, the cover being rotatable between an opened position and a closed position, the tail being spaced from the bottom more in the opened position than the closed position;

a sliding bar connected for sliding movement relative to the frame, the sliding bar being mounted between the bottom and the cover when the cover is in the closed position;

a cam surface on a side of to cover that faces the bottom when the cover is in the closed position, the cam surface being positioned so that it extends downward from the cover between the pivotal connection of the cover and the sliding bar when the cover is in the closed position; and a hump on the bottom positioned rearward of the sliding bar and for directing webbing inserted through the gap upward from the bottom.

21. An end-fitting buckle, comprising:

a frame having a bottom;

a cover pivotally attached to the frame at a location on the frame spaced from the bottom so as to form a gap therebetween, the cover having a tail spaced from the pivotal attachment to the frame, the cover being rotatable between an opened position and a closed position, the tail being spaced from the bottom more in the opened position than the closed position;

a bar mounted between the bottom and the cover when the cover is in the closed position; and a hump on the bottom positioned rearward of the bar and for directing webbing inserted through the gap upward from the bottom.

* * * * *